US005267460A

United States Patent [19]

Burleigh

[11] Patent Number: 5,267,460

[45] Date of Patent: Dec. 7, 1993

[54] COMBINATION LOCK

[75] Inventor: Charles E. Burleigh, Salem, Oreg.

[73] Assignee: Supra Products, Inc., Salem, Oreg.

[21] Appl. No.: 795,662

[22] Filed: Nov. 21, 1991

[51] Int. Cl.[5] ..... E05B 37/04

[52] U.S. Cl. ..... 70/309; 70/316; 70/333 R; 70/302; 70/DIG. 52; 70/63

[58] Field of Search ..... 70/316, 317, 333 R, 70/63, 321, 322, 302, 303 R, 303 A, DIG. 52, 422, 309

[56] References Cited

U.S. PATENT DOCUMENTS

| | | | |
|---|---|---|---|
| 907,038 | 12/1908 | Greene | 70/303 R |
| 929,712 | 8/1909 | Runkle | 70/303 R |
| 1,308,521 | 7/1919 | Butter | 70/422 |
| 1,472,577 | 10/1923 | Baer | 70/322 |
| 1,600,338 | 9/1926 | Jones | 70/309 |
| 3,798,936 | 3/1974 | Oliver | 70/264 |
| 3,800,576 | 4/1974 | Barrett et al. | 70/302 |
| 4,106,801 | 8/1978 | DeLima Castro Neto | 292/307 R |
| 4,626,007 | 12/1986 | Larson | 292/65 |
| 4,803,859 | 2/1989 | Miller et al. | 70/333 R |
| 4,901,546 | 2/1990 | Uyeda et al. | 70/333 R |

FOREIGN PATENT DOCUMENTS

| | | | |
|---|---|---|---|
| 1505159 | 10/1967 | Italy | 70/DIG. 52 |

*Primary Examiner*—Peter M. Cuomo
*Assistant Examiner*—Darnell M. Boucher
*Attorney, Agent, or Firm*—Klarquist, Sparkman, Campbell, Leigh & Whinston

[57] ABSTRACT

A combination lock for a key safe has an over-center spring for biasing a unitary bolt in an extended or retracted position. A switch for actuating the bolt has a break-away button to foil vandals. The bolt includes checkers for engaging notches in a plurality of programmable combination rings when the combination is properly dialed. The checkers have V-shaped ridges for engaging false notches formed in the combination rings, making the lock pick-resistant. The checkers also include flat shoulders to prevent the bolt from being forcibly wedged into the combination rings to open the lock. The combination must be properly dialed to permit the bolt to be retracted for closing the key safe.

13 Claims, 2 Drawing Sheets

COMBINATION LOCK

TECHNICAL FIELD

This invention relates to re-programmable combination locks, and more particularly to such locks for use in securing key safes.

BACKGROUND AND SUMMARY OF THE INVENTION

This application is directed towards an improvement over U.S. Pat. No. 3,800,576 to Barrett et al., and U.S. Pat. No. 4,626,007 to Larson, which are incorporated herein by reference.

Barrett discloses a combination lock having shiftable combination rings for re-programming. The rings are rotatably mounted with a knob, and each defines a notch. The notches are engaged by a set of checkers on a bolt when the rings are aligned in the proper combination so that the bolt may be retracted. The bolt is spring biased to the extended position, so that it engages the edge of an aperture in a key box secured by the lock. The bolt has several parts that slide relative to one another, allowing the extended bolt to cam against the edge of the aperture. The extended portion of the bolt thereby retracts, permitting the keybox to be closed and locked when the combination rings are in a scrambled, locked position.

Several of the limitations in the prior art relate to the security and tamper-resistance of the existing locks. Although no lock is perfectly secure or tamper-proof, locks produced according to the above-referenced patents are extremely effective and are widely used. Nonetheless, a reduction in an already small security risk is desireable.

A drawback of the prior art multi-part spring biased bolt is that the lock may be closed and locked after re-programming without the user having confirmed the newly re-programmed combination. Thus, an error in programming that easily would be detected and corrected before the keybox is closed and locked becomes impossible to correct without damaging or destroying the lock or keybox.

Some spring-loaded bolts may be defeated by skillfully applied external shocks to the lock or housing to dislodge the bolt. Multi-part bolts such as shown in Larson and Barrett may also be defeated by a skillful intrusion into the lock to damage certain critical mechanical elements therein.

Any access to the lock interior may be helpful to an intruder. The prior art locks include a switch button which, although generally well secured, may be removed with skillfully applied extreme force. This may provide an aperture to the interior of the lock. Also, because the spring loaded bolt is not integrally connected with the external switch button, the appearance of the button does not provide a visual indication of a failure of the lock to properly close and latch.

The design of the ring-notch-engaging checkers on existing lock bolts creates other security weaknesses. When the checker end surfaces are generally flat, a skilled intruder may manipulate the rotary knob while applying pressure to the switch button to tactilely sense the positions of the ring notches. To avoid this, pointed checkers have been used in conjunction with an array of shallow false notches on the combination rings to make such lock picking nearly impossible. However, sharply pointed checkers may be wedged into the rings by pounding on the switch button, which may drive the bolt sufficiently far to release the lock.

From the foregoing it will be recognized that there is a need for a combination lock that overcomes these drawbacks of the prior art.

In accordance with the preferred embodiment of the present invention, this need is fulfilled by providing a unitary bolt controlled by an over center spring so that the bolt is stable in both the extended and retracted positions. The combination rings are removable for reprogramming only when the bolt is in the extended position. In this position, however, the bolt prevents the door from being latched to the box. To retract the bolt, the combination must first be dialed properly. The lock's switch button is directly engaged with the bolt so that it provides a visual indication of the bolt position. The button also includes a weakened section so that the external portion of the button will break away when subject to force, while the internal portion remains attached to the lock to prevent access. The bolt includes ring-notch-engaging checkers, each having a generally flat surface to prevent forcible wedging of the checker into a combination ring, but with each checker also including a small ridge for engaging false notches to prevent picking.

The foregoing and additional features and advantages of the invention will be more readily apparent from the detailed description, which proceeds with reference to the drawings.

DESCRIPTION OF A PREFERRED EMBODIMENT

Figure 1:
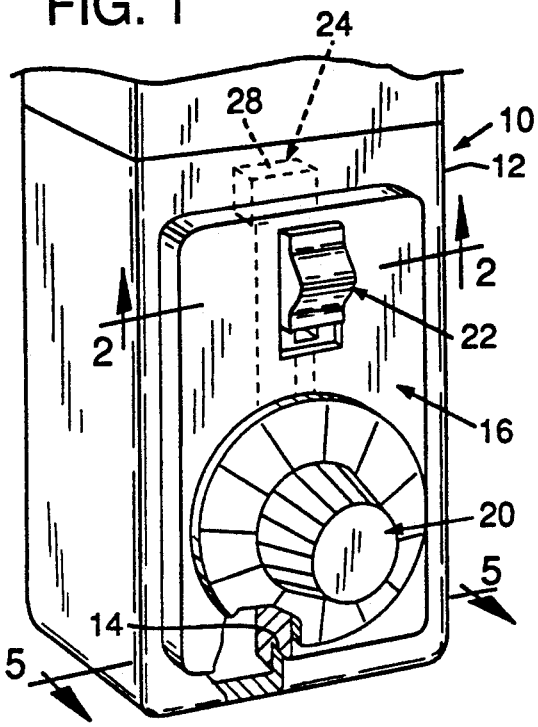
FIG. 1 is a fragmentary perspective view of a lock according to one embodiment of the present invention.

FIG. 1 shows a combination lock 10 generally including a box or case 12 defining a door aperture 14. The aperture 14 is entirely enclosed by a door 16 which carries a combination lock mechanism. A rotary knob 20 for dialing a lock combination is mounted externally on the door 16. A sliding switch button 22 is mounted externally on the door and is directly connected to a bolt 24, which is slidably mounted with the door in the interior of the case 12. The button 22 and bolt 24 are together slidable between an extended locked position and a retracted unlocked position. As shown in FIG. 1, in the extended locked position a free end latch portion 28 of the bolt engages the aperture 14 of the case 12. In the retracted unlocked position, the bolt 24 is drawn into the door 16 so that the door may be removed from the case 12.

Figure 2:
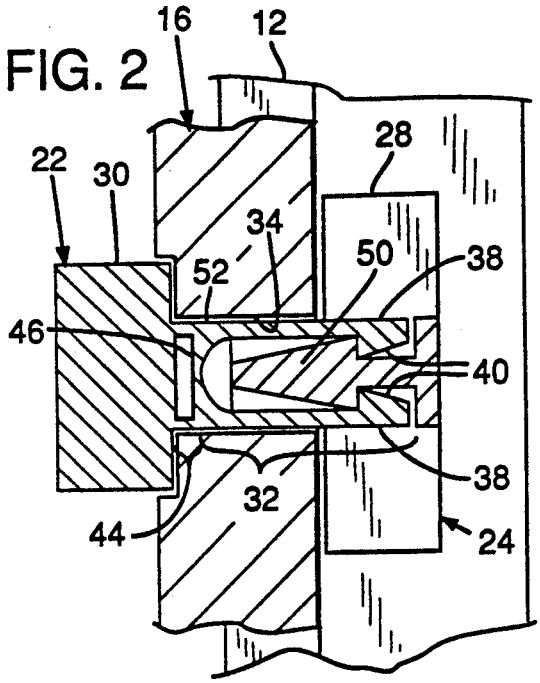
FIG. 2 is an enlarged sectional top view of the lock of FIG. 1 taken along line 2—2.

FIG. 2 shows how the button 22 attaches to the bolt 24. The button 22 includes an outer portion 30 mounted externally of the door 16 and an elongated inner portion 32 extending perpendicularly into the interior of the door 16 through a button slot 34 defined therein. The inner portion 32 includes a pair of parallel elongated arms 38 each terminated by an inwardly facing hook 40.

The button 22 includes an intermediate portion 44 that connects the inner portion 32 to the outer portion 30. The intermediate portion 44 defines a break-away gap 46, which occupies a substantial portion of the cross-sectional area of the intermediate portion. The gap 46 preferably is large enough so that the remaining button material at the intermediate portion has a smaller total cross-sectional area than any point along the inner portion 32. Thus, any abusive force applied to the outer portion 30 of the button 22 results in the button splitting away at the intermediate portion 44. The inner portion 32 will remain within the button slot 34 of the door 16 to prevent an intruder from accessing the interior of the lock through the button slot.

The break-away 46 ma be shaped with sharp interior corners to provide stress concentrations and further facilitate the break-away feature of the button 22.

The bolt 24 includes an arrowhead-shaped section 50 in registration with the button slot 34, and configured so that the elongated arms 38 of the button 22 flex outwardly as they cam against the tapered nose of the arrowhead 50 when the button 22 is installed on the bolt 24. When the button is fully installed, the hooks 40 engage the arrowhead section 50, allowing the arms 38 to spring inward, locking the button in place.

Figure 3:
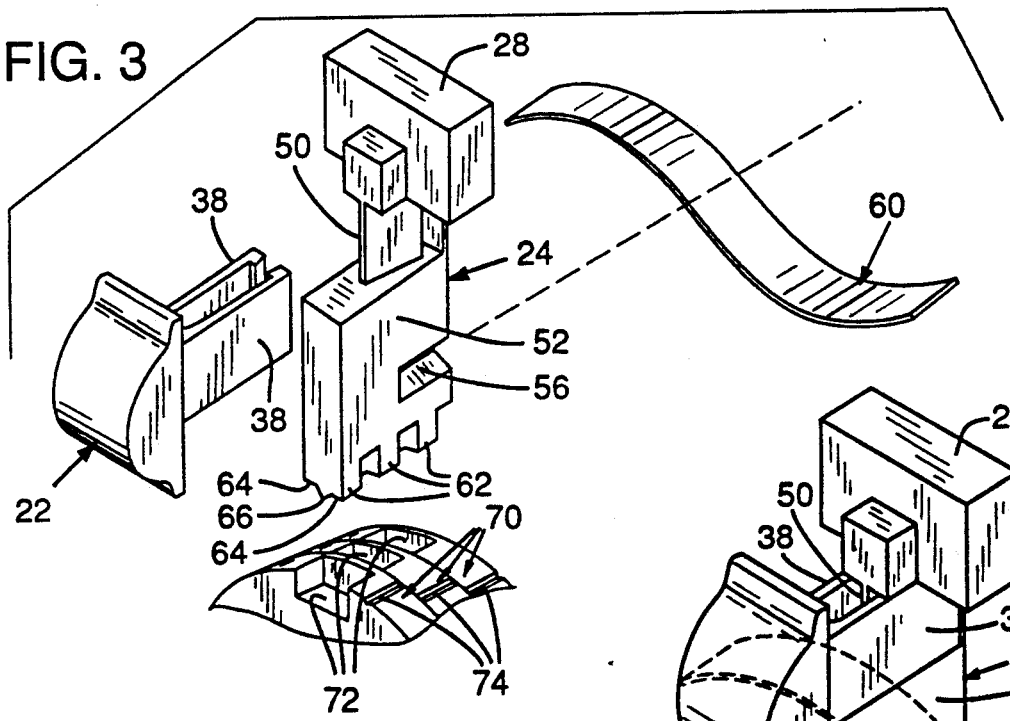
FIG. 3 is an exploded perspective view of the lock of FIG. 1.

FIG. 3 shows an exploded view of the lock mechanism. The bolt 24 is shown with the case-engaging free end 28 extending upward. The button-engaging arrowhead section 50 is positioned below the free end latch portion 28. Below the arrowhead section 50, a bolt body section 52 defines a horizontal spring receiving slot 56 open in the direction facing the rear of the lock. The slot 56 is narrowest at its center and widest at its sides, forming a bow-tie cross-section so that a leaf spring 60 may be closely received by the center of the slot, but with clearance at the sides of the slot to permit the spring a range of angular orientations relative to the bolt 24.

The bolt 24 is terminated at its lower end opposite the free end 28 by three linearly arranged downwardly protruding checkers 62. The lower surface of each checker 62 includes a pair of downwardly facing, flat shoulder surfaces 64. A V-shaped ridge 66 separates the shoulders 64, with the ridge 66 of each checker 62 being positioned on a single line.

Three combination rings 70 are positioned on the axis of the knob 20 (FIG. 1) to rotate therewith. Each ring 70 is aligned with a respective checker 62, with the axis of the rings 70 being parallel to the line of checker ridges 66. The periphery of each ring defines a notch 72 sized to receive a checker 62. Each notch 72 is sufficiently deep so that the bolt be drawn into the retracted unlocked position when the notches are aligned with the checkers. The periphery of each ring further defines a plurality of false notches 74. The false notches are V-shaped to admit only the V-shaped ridges 66 of the checkers 62, while preventing the bolt 24 from being fully retracted. Thus, an intruder may not pick the lock by using a gentle downward force on the button 22 to sense the position of the notches 72. The false notches 74 act as decoys, effectively making such an attempt impossible. In addition, the shoulder surfaces 64 function to prevent the bolt from being driven destructively into the combination rings 74, as may be possible with sharp, wedge-shaped checkers.

Figure 4:
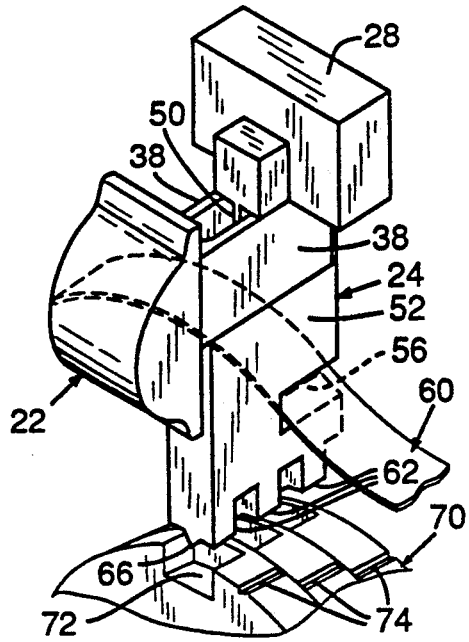
FIG. 4 is an enlarged perspective view of the functional elements of the lock of FIG. 1.

FIG. 4 shows the partially-assembled lock mechanism with the button 22 attached to the bolt 24 and the spring 60 received within the slot 56.

Figure 5:
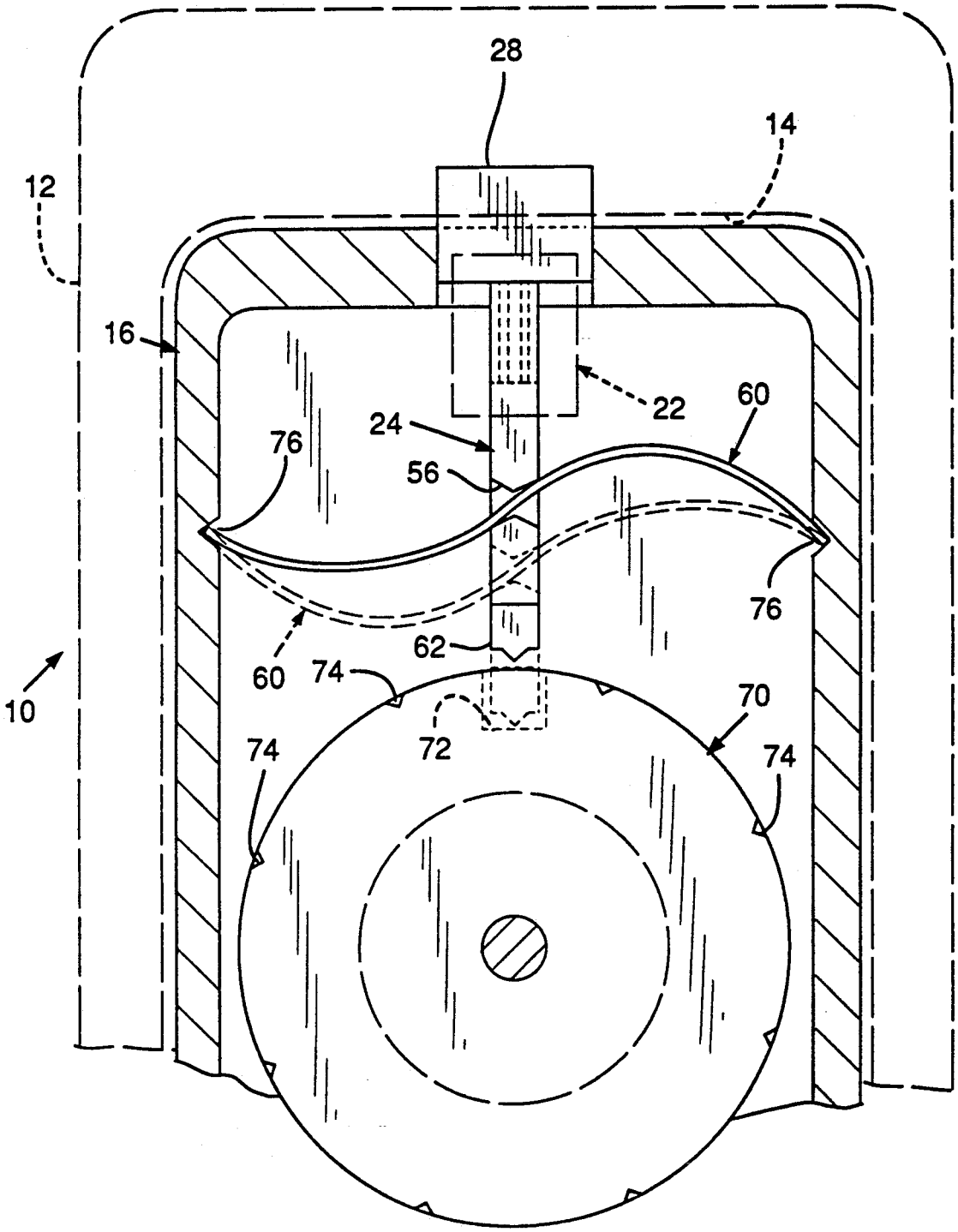
FIG. 5 is a sectional view of the lock of FIG. 1 taken along line 5—5.

FIG. 5 illustrates the function of the over-center spring 60. The door 16 defines a pair of opposed grooves 76 for receiving the ends of the spring 60. The grooves 76 are spaced apart by a distance less than the unconstrained length of the S-shaped spring 60. Thus, the spring will be unstable in an intermediate position. The spring is stable in either off-center position shown, with the locked, bolt-extended position shown in solid lines and the unlocked, bolt-retracted position shown in dashed lines. The S-shape of the spring provides a reduced hysteresis effect by allowing the spring to "flop" in the desired direction shortly after it is forced past the center point. Thus, the spring is useful for bolts having a short throw. The spring may optionally be aligned with the "flop" point off-center, so that the biasing force holding the bolt is greater or less than the biasing force holding the bolt retracted.

Having illustrated and described the principles of my invention by what is presently a preferred embodiment, it should be apparent to those skilled in the art that the illustrated embodiment may be modified without departing from such principles. I claim as my invention not only the illustrated embodiment, but all such modifications, variations and equivalents thereof as come within the true spirit and scope of the following claims.

I claim:

1. A combination lock comprising:

a case;

a plurality of combination rings mounted for rotation within the case, each ring defining a notch;

a bolt assembly mounted for longitudinal sliding movement within the case between an extended position and a retracted position, the bolt assembly including a bolt having notch-engaging checkers for engaging the notches in the rings to permit the bolt to be moved to the retracted position when the notches are aligned with the checkers, and for engaging at least one of the combination rings for retaining the bolt in the extended position when the notches are not aligned with the checkers; and a spring of a general S-shape having fixed opposite ends and an intermediate portion which engages the bolt for controlling its sliding movement by retaining the bolt in the retracted position when the bolt is retracted, retaining the bolt in the extended position when the bolt is extended, and biasing the bolt toward the nearer of the retracted or extended positions when the bolt is in an intermediate position.

2. The lock of claim 1 wherein the spring is an over center leaf spring.

3. A combination lock comprising;

a case;

a plurality of combination rings mounted for rotation within the case, each ring defining a notch;

a bolt having a latch portion mounted for longitudinal sliding movement within the case between an extended position and a retracted position, the bolt having notch-engaging checkers for engaging the notches to permit the bolt to be moved to the retracted position with the latch portion unlocked when the notches are aligned with the checkers, and for engaging at least one of the combination rings for retaining the bolt in the extended position with the latch portion locked when the notches are not aligned with the checkers, wherein the bolt and checkers are formed as a single member with the latch portion.

4. A combination lock comprising:

a case;

a plurality of combination rings mounted for rotation within the case, each ring defining a notch;

a bolt slidable within the case between an extended position and a retracted position, the bolt having notch-engaging checkers for engaging the notches to permit the bolt to be moved to the retracted position when the notches are aligned with the checkers, and for engaging at least one of the combination rings for retaining the bolt in the extended position when the notches are not aligned with the checkers; and mounting means for mounting the bolt and the combination rings on a case door so that said rings are removable from the case upon opening of said door for reprogramming a lock combination only when the bolt is in the extended position, and said combination rings are securely engaged by the checkers when the belt is in the retracted position, such that the lock combination must be dialed before retracting the bolt.

5. A combination lock comprising:

a case;

a plurality of combination rings mounted for rotation within the case, each ring defining a notch;

a bolt slidable within the case between an extended position and a retracted position, the bolt having notch-engaging checkers for engaging the notches to permit the bolt to be moved to the retracted position when the notches are aligned with the checkers, and for engaging at least one of the combination rings for retaining the bolt in the extended position when the notches are not aligned with the checkers;

wherein each notch-engaging checker of the bolt terminates with a generally flat, wide checker end surface having a protruding portion with a width less than the width of the end surface.

6. The lock of claim 5 wherein the protruding portion comprises a V-shaped ridge.

7. A combination lock comprising:

a case;

a plurality of combination rings mounted for rotation within the case, each ring defining a notch;

a bolt slidable within the case between an extended position and a retracted position, the bolt having notch-engaging checkers for engaging the notches to permit the bolt to be moved to the retracted position when the notches are aligned with the checkers, and for engaging at least one of the combination rings for retaining the bolt in the extended position when the notches are not aligned with the checkers; and a button operably engaged to the bolt, the button having an outer portion outside the case, an inner portion inside the case and secured to the bolt by a pair of spaced flexible arms terminating in hooks which engage a tapered nose portion of the bolt to cam the arms apart as the bottom is pushed inwardly until the hooks engage the rear of said nose portion, and an intermediate portion with a lower breakage resistance than the inner and outer portions, such that the button will break at the intermediate portion in response to excessive force applied to the outer portion leaving the inner portion attached to the nose portion.

8. The lock of claim 7 wherein the intermediate portion of the button has a smaller cross-sectional area than the inner and outer portions.

9. The lock of claim 7 wherein the inner portion of the button remains secured to the bolt after breakage of the intermediate portion, such that access to the case interior is prevented.

10. A combination lock apparatus for securing a key within a case, comprising:

a case having a door;

a plurality of notched combination rings mounted for rotation on the door;

a bolt assembly mounted on the door for longitudinal sliding movement within the case between an extended position for locking the door and a retracted position for unlocking the door, the bolt having checkers with notch-engaging ends for engaging combination notches on the rings to permit the bolt to be moved to the retracted position when the combination notches are aligned with the checkers, and for engaging false notches on the rings of less depth than the combination notches for retaining the bolt in the extended position when the combination notches are not aligned with the checkers and;

said notch-engaging end having a generally flat end surface and a protruding portion having a width less than the width of the end surface.

11. An apparatus in accordance with claim 10 in which the checkers each have a notch engaging end with a flat portion and a pointed portion which enters the false notch while the flat portion engages the ring adjacent said false notches.

12. An apparatus in accordance with claim 10 in which the bolt is held in the retracted position and in the extended position by an over center spring.

13. An apparatus in accordance with claim 12 in which the spring is an S-shaped leaf spring.

* * * * *